United States Patent [19]

Maynard et al.

[11] Patent Number: 4,482,426

[45] Date of Patent: Nov. 13, 1984

[54] METHOD FOR ETCHING APERTURES INTO A STRIP OF NICKEL-IRON ALLOY

[75] Inventors: Richard B. Maynard, Colerain Township, Lancaster County; John J. Moscony, Manheim Township, Lancaster County; Margaret H. Saunders, East Lampeter Township, Lancaster County, all of Pa.

[73] Assignee: RCA Corporation, New York, N.Y.

[21] Appl. No.: 595,933

[22] Filed: Apr. 2, 1984

[51] Int. Cl.[3] ..... C23F 1/02; B44C 1/22; C03C 15/00

[52] U.S. Cl. ..... 156/640; 156/642; 156/644; 156/664; 156/345; 252/79.2

[58] Field of Search ..... 252/79.2; 156/640, 644, 156/642, 656, 659.1, 664; 430/23, 313, 318

[56] References Cited

U.S. PATENT DOCUMENTS

| | | | |
|---|---|---|---|
| 3,788,915 | 2/1972 | Gulla | 156/19 |
| 4,061,529 | 12/1977 | Goldman et al. | 156/644 |
| 4,389,279 | 6/1983 | Weber et al. | 156/640 |
| 4,396,475 | 8/1983 | Stehlik | 204/130 |
| 4,420,366 | 12/1983 | Oka et al. | 156/644 |

*Primary Examiner*—William A. Powell

*Attorney, Agent, or Firm*—E. M. Whitacre; D. H. Irlbeck; L. Greenspan

[57] ABSTRACT

A method for etching a strip of iron-nickel alloy, such as invar steel, having etch-resistant stencils on opposite major surfaces thereof includes contacting the stencilled surfaces with a ferric-chloride etchant. The etchant is controlled (a) to contain not more than 5 molar percent nickel ion with respect to the total content of nickel and iron ions, (b) to have a specific gravity greater than about 1.495 (48° Baumé) (c) and to have a temperature greater than 70° C.

18 Claims, 5 Drawing Figures

METHOD FOR ETCHING APERTURES INTO A STRIP OF NICKEL-IRON ALLOY

BACKGROUND OF THE INVENTION

This invention relates to a novel method for etching precisely-sized and shaped apertures into a strip of nickel-iron alloy; for example, invar steel. The etched product may be used to make shadow masks for color television picture tubes, as well as other precision-etched products.

A common type of color television picture tube comprises an evacuated glass envelope having a viewing window, a luminescent viewing screen supported by the inner surface of the viewing window, a formed shadow mask closely spaced from the viewing screen and an electron-gun mount assembly for generating one or mre electron beams for selectively exciting the screen to luminescence. The formed shadow mask, which is a thin metal membrane having precisely-sized and shaped apertures therethrough, is used as a photographic master for making the screen, and then is used, during the operation of the tube, to aid in color selection on the screen by shadowing the electron beams. In both of these functions, it is important that the apertures therein follow closely in sizes and shapes with the mask specifications.

A flat mask is ordinarily made in several steps including producing etch-resistant stencils on opposite surfaces of a strip of low-carbon steel and then etching through the stencilled strip with a ferric-chloride etchant. The flat mask is then removed from the strip and formed to a desired shape. The strip is ordinarily about 0.10 to 0.20 mm (4–8 mils) thick, and the apertures therein may be round or slit shaped and may range in diameter or width from about 0.25 mm (10 mils) to less than the thickness of the strip. In addition, the profiles of the apertures are tapered so as to reduce scattering of electrons during tube operation. Each aperture has a "knife edge" at its smallest diameter or width which defines the shape of the electron beamlet passing therethrough. That smallest diameter should be precisely shaped, and the tapered surface should be as smooth as possible to achieve this feature and also to reduce electron scattering.

For some picture tubes, it is desirable to fabricate the shadow mask from a strip of invar steel, which is an alloy containing about 36% nickel and about 64% iron. Invar steel masks have a relatively low coefficient of thermal expansion and greater structural strength than low-carbon steel. Thereby, an invar steel mask exhibits less dimensional change when it is heated during tube operation and also can be made from thinner strip material.

The parameters to be controlled during the etching phase for low-carbon-steel shadow masks are well known in the art. These include control of etchant temperature, Baumé (specific gravity), redox potential, free-acid concentration, line speed, spray pressure and location of spray nozzles with respect to the metal strip in the etch chamber. However, when etching invar steel masks an additional parameter is introduced, the nickelous ion ($Ni^{2+}$) concentration in the etchant. This results from the oxidation of elemental nickel in the invar alloy via the reduction of ferric ions in the etchant. With continued etching, the nickel ion concentration in the ferric-chloride etchant will increase until it approximates the 36 weight percent composition of the invar alloy. since nickelous ion will not oxidize elemental iron, or nickel in the invar alloy, or be further transformed to a higher oxidation state by chlorine gas, it contaminates and dilutes the ferric-chloride etchant. This has several deleterious effects upon the etching process. It slows the etch rate (and hence productivity) of the etch line and produces rough etch resulting in poor visual uniformity in the finished mask.

It is to be understood that by rough or smooth etch we refer to the surface roughness of the metal on the inside of the apertures in the shadow mask. A surface roughness of $\leqq 10$ microinches (smooth etch) results in a mask with good visual uniformity. Increases above this value in surface roughness (rough etch) contribute to a general decline in visual uniformity to transmitted light in the finished mask. This, in turn, degrades the ambient appearance of the phosphor screen produced with the mask, and also the white uniformity of the screen in an operating picture tube.

Some of the foregoing problems are addressed in U.S. Pat. No. 4,420,366 issued Dec. 13, 1983 to K. Oka et al., which discloses a method for etching nickel-iron shadow masks. The method disclosed in the Oka et al. patent requires the ferric-chloride etchant to have a controlled content of free hydrochloric acid, a temperature in the 40° to 70° C. range, a total amount of nickelous and ferrous irons not more than 15 weight percent and a specific gravity in about the 1.420 to 1.540 range (43° to 51° Baumé) depending upon the temperature of the etchant. Our data indicates that the problems are only partly overcome by the method disclosed in the Oka et al. patent, and that further significant improvements are possible. The novel method permits more accurate control of the etching step using ordinary process-control equipment, while consistently producing masks within close specification. Furthermore, the novel method is economical in etching time and in the consumption of etchant.

SUMMARY OF THE INVENTION

The novel method, as in prior methods, includes contacting the stencilled major surfaces of a strip of nickel-iron alloy with a ferric-chloride etchant until the desired amount of etching is completed. Unlike prior methods, the ferric-chloride etchant is controlled (a) to contain not more than 5 molar percent nickel ion with respect to the total content of nickel and iron ions, (b) to have a specific gravity greater than about 1.495 (48° Baumé) and (c) to have a temperature greater than 70° C. The most productive combinations during etching employ the higher temperatures, lower concentrations of nickel ions, and the lowest specific gravities at which smooth etch can be achieved.

The nickel-ion concentration can be maintained in apparatus which recirculates the etchant, by continually withdrawing a fraction of the etchant which contains a relatively high concentration of nickel ions and replacing it with etchant that has a low concentration of, or is free from, nickel ions. Further economy can be realized by removing some or all of the nickel-ion content from the withdrawn fraction and returning the regenerated etchant to the recirculating etchant.

DETAILED DESCRIPTION OF THE PREFERRED EMBODIMENT

Figure 1:
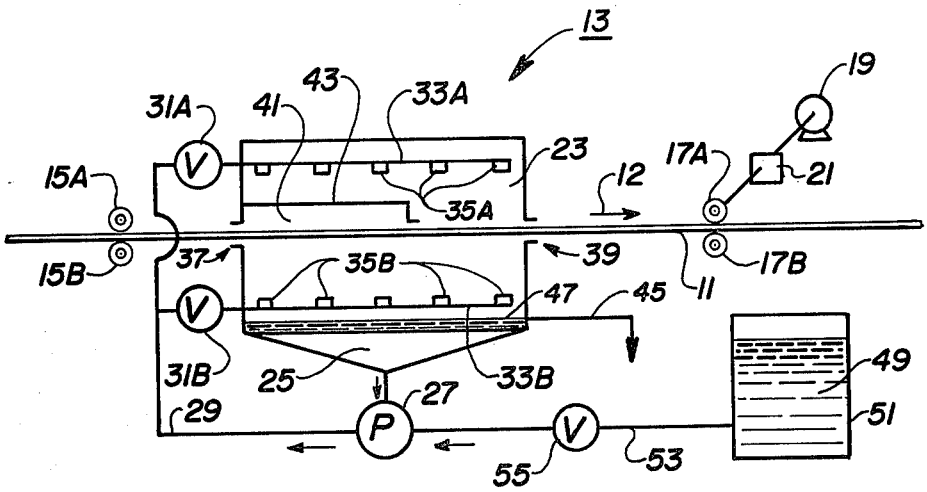
FIG. 1 is a schematic representation of an apparatus that may be used for practicing the novel method.

The novel method may be practiced in the continuous etching apparatus disclosed in U.S. Pat. No. 4,389,279 issued June 21, 1983 to D. M. Weber et al. FIG. 1 herein is a schematic representation of the apparatus modified to permit the continuous removal of nickelous ions from the etchant. The novel method may be practiced in other apparatus ordinarily used for etching apertures into a strip of metal.

FIG. 1 shows a horizontally-oriented strip 11 of invar steel to be etched while it is moving through an etching station 13 from left to right as shown by the arrow 12. The strip, which is about 21.375 inches wide and 0.15 mm (6 mils) thick, moves at about 300 to 1500 mm (about 12 to 60 inches) per minute through the station. The strip 11 carries etch-resistant stenciles on both major surfaces, substantially as described in U.S. Pat. No. 4,061,529 issued Dec. 6, 1977 to A. Goldman et al. The strip 11 is supported between a first pair of rollers 15A and 15B and a second pair of rollers 17A and 17B on the entrance and exit sides, respectively, of the etching station 13. The strip 11 is moved by the rotation of the upper roller 17A of the second pair, which is driven by a motor 19 through a variable-speed reducer 21.

The etching station 13 comprises a closed etching chamber 23, the bottom of which is a sump 25 below the strip 11. Liquid etchant in the sump is pumped by a pump 27 through piping 29 through top and bottom valves 31A and 31B through top and bottom headers (not shown) into spray tubes 33A and 33B respectively and sprayed out of upper and lower nozzles 35A and 35B respectively toward the moving strip 11. The etchant is sprayed with a pressure in the range of about 10 to 40 pounds per square inch. The sprayed etchant etches the exposed metal of the strip 11 and then drains to the sump.

The etching chamber 23 has an entrance port 37 and an exit port 39. A shielding chamber 41 defined by a solid wall 43 and the upper major surface of the strip 11 extends from the entrance port 37 over about half the length of the etching chamber 23. The shielding chamber 41 (which may be removed if desired by removing the wall 43) shields the upper major surface of the strip 11 from etchant during the initial portion of the etching step, while permitting etchant to impinge upon the lower major surface of the strip 11.

The sump 25 has an overflow port and pipe 45 which limits the level 47 of the etchant in the sump and also the amount of etchant in the apparatus. Fresh etchant 49, which is substantially free from nickel ions, contained in a reservoir 51 is continuously fed into the apparatus through an etchant supply pipe 53 and valve 55 to the pump 27. Excess amounts of etchant containing nickel ions are removed from the apparatus through the overflow pipe 45.

Except for the alloy of the strip 11, the etchant used, the supply of fresh etchant, and the overflow of excess etchant from the sump 25, the operation of the apparatus 13 is the same as described in the above-cited patent to Weber et al. In this example, the fresh etchant 49 is a ferric-chloride solution having a temperature of about 80° C. and a specific gravity of about 1.510 (49° Baumé). The etchant in the sump 25 is maintained at about the same temperature and specific gravity, and the concentration of nickelous ions (which are produced by the etching of the strip 11) is controlled to be as low as possible and below 5 molar percent with respect to the total molar content of nickel and iron ions in the etchant in the sump.

GENERAL CONSIDERATIONS

We have discovered that, when etching a strip of nickel-iron alloy, such as invar steel which contains about 36 weight percent nickel, and using conditions similar to those previously used in the art of etching low-carbon-steel strip, that an increase in the nickelous ion concentration in the ferric-chloride etchant, resulting from the dissolution of the alloy by the etchant, raises the required minimum Baumé necessary to maintain a smooth etch, and also decreases the rate of etching so that the line speed of the strip must be decreased. Our discovery applies to etching any nickel-iron alloy, especially alloys which contain at least 10 weight percent nickel.

Figure 2:
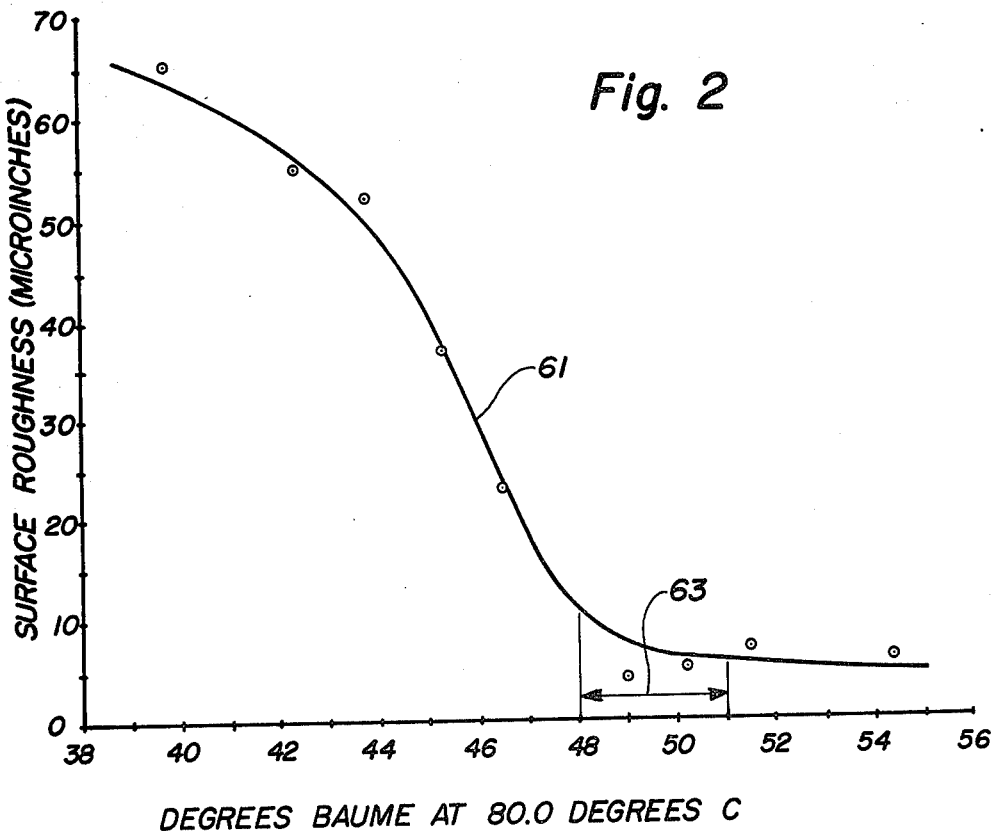
FIG. 2 is a curve showing the roughness of the etched surface produced by etchants of different specific gravities expressed in Baumés.

When etching invar steel with different nickel-free ferric-chloride etchants, a relatively-sharp transition in surface roughness occurs as the Baumé of the etchant is decreased. An example of this observed behavior is shown by the curve 61 in FIG. 2. As the Baumé decreases from a relatively-high value of about 53° Baumé, where a smooth surface finish of about 5 microinches is produced, the surface finish changes abruptly over a narrow range of 48.6° to 47.6° Baumé to a rough finish of more than 10 microinches at the lower Baumés. The transition region from a smooth to a rough surface finish for invar steel is essentially independent of temperature over the 40° to 85° C. (104° to 185° F.) temperature range. In contrast, cold-rolled 1008 rimmed steel strip etched with ferric-chloride etchant exhibits a temperature-dependent transition region varying from about 43° Baumé at 40° C. to about 48° Baumé at 80° C. The practical range for the novel method is 48.0° to 51.0° Baumé (1.495 to 1.540 specific gravity) as shown by the arrow 63.

Figure 3:
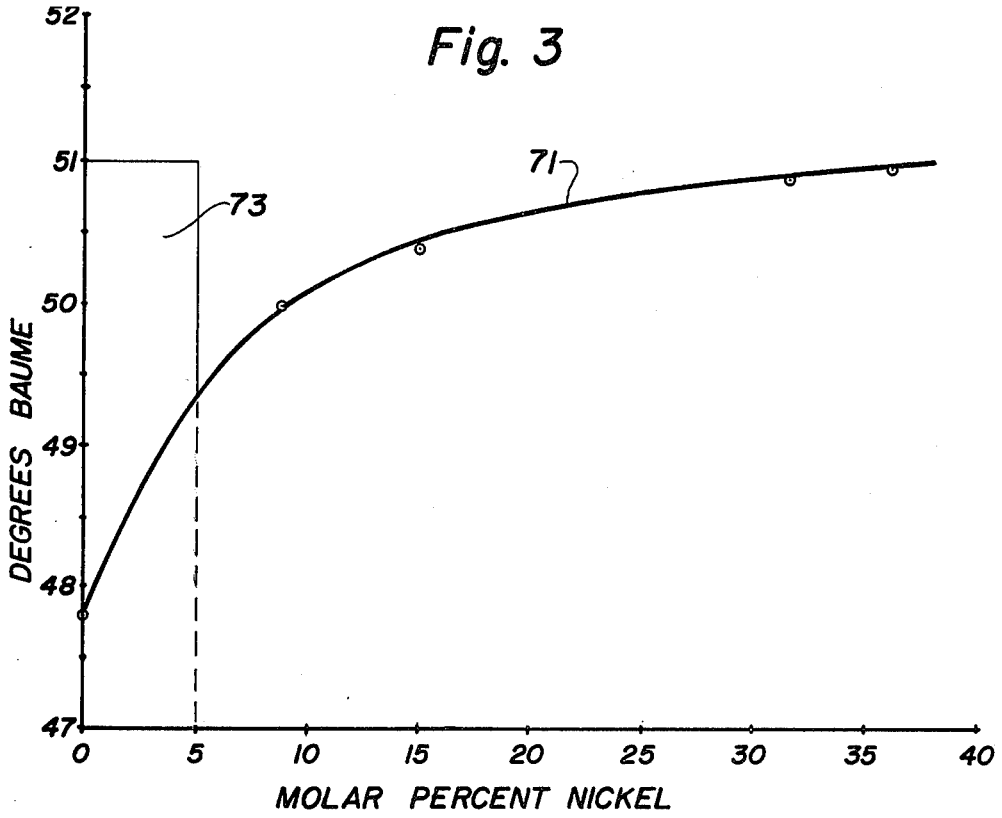
FIG. 3 is a curve showing the increase in specific gravity expressed in Baumé of the etchant required to produce a smooth surface (less than 10 microinches) for etchants containing different concentrations of nickel cations.

The presence of nickelous ions in the ferric-chloride etchant can have a profound effect upon the transition Baumé of the etchant as shown by the curve 71 of FIG. 3. An increase in nickelous ion concentration requires an increase in Baumé to maintain a smooth etch. The minimum Baumé required to achieve smooth etch as a function of molar percent nickelous cation (relative to the total molar content of nickel plus iron ions in the etchant) in the ferric chloride etchant can be described by the empirical relationship $$x=47.824+0.337x-0.0131x^2+0.00017x^3$$

where x is the molar percent nickelous ion present and y is the minimum Baumé required to produce a smooth etch in the strip. This empirical relationship is also essentially independent of etchant temperature in the temperature range ordinarily used to etch apertures in steel strips with ferric-chloride etchant. The Baumé of the etchant must be kept in the range of about 48.0 to 51.0 degrees and the nickelous concentration in the etchant must be kept in the range of 0 to 5 molar percent as shown by the area 73 in FIG. 3 to be practical.

The presence of increasing concentrations of nickelous ions in the etchant increasily reduces the etching rate. In addition, increasing specific gravities (Baumé) increasingly reduces the etching rate. Thus, the most productive combinations of characteristics for etching apertures in nickel-iron alloy strip employ etchant with the highest practical etching temperatures, the lowest specific gravities at which smooth etch can be achieved and the lowest possible concentrations of nickelous ions up to 5 molar percent. In practice, these combinations from the following ranges are required: 70° to 85° C., 48.0 to 51.0 Baumé and 0 to 5 molar percent nickelous ion concentration.

Figure 4:
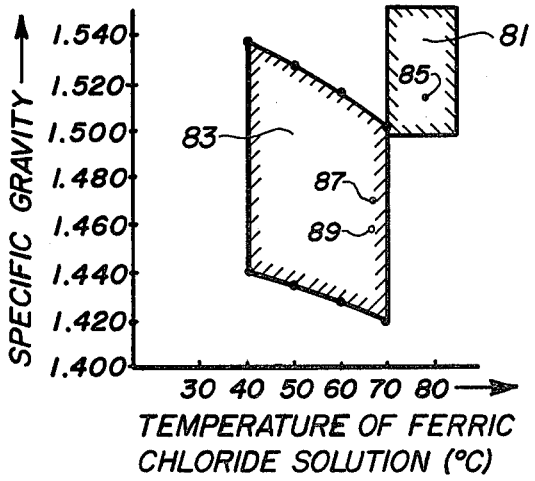
FIG. 4 is a diagram comparing conditions of temperature and specific gravity of etchant for the novel method and a prior method.

The ranges for Baumé (specific gravity) and temperature of the novel method are shown by the rectangular first area 81 in FIG. 4. The odd-shaped second area 83 of FIG. 4 defines the ranges required for the method disclosed in the above-cited patent to Oka et al. While the two areas abut, they do not overlap. Also the Oka et al. patent does not disclose the importance of the presence of nickelous ions in the etchant upon the etching speed of the etchant or the roughness of the etched surface. We have investigated etchants in both areas. Typically, the etchant at the point 85 in the first area 81 produces a smooth etch with well-formed apertures and good visual uniformity. The two etchants at the points 87 and 89 in the second area 83 produce rough etch and poor visual uniformity in similar invar steel strip.

We have observed that the upper practical temperature limit for production etching with ferric chloride etchant is about 85° C. (185° F.). When the ferric chloride etchant contains 5 molar percent or less nickelous ion, the desired Baumé, as disclosed in this work, the specific gravity of the etchant should be at least 48° and preferably 49° Baumé to obtain smooth etch. By way of example, the etch rate of invar steel on one particular etch line, using ferric-chloride etchant at 80° C. and 49° Baumé was found to be approximately $2.0\times10^{-4}$ g/cm$^2$−sec for a particular 25-inch shadow mask artwork. Under these conditions, in order to obtain masks with good visual uniformity (smooth etch) at a high rate of productivity, the etch sump tank may be allowed to overflow at an approximate rate of $y=[2.0\times10^{-4}$ g/cm$^2$−sec times the exposed surface area of 25 V mask in cm$^2$ times 1/1.51 g/ml] in (ml/sec), and fresh ferric-chloride etchant is added equivalent to the amount lost in the overflow. In this manner, the etch rate is maintained substantially constant and approximately equal to the etch rate for pure ferric-chloride etchant.

Further economy can be added by processing the overflow etchant from the etch tank to regenerate ferric-chloride etchant low in nickelous ion, and/or recovering the nickelous ion as nickel metal for salvage resale. One means for accomplishing this is described in U.S. Pat. no. 4,396,475 issued Aug. 2, 1983 to W. Faul et al., whereby a two- or multi-chambered cell divided by a suitable ion exchange membrane can with minor modifications be utilized to electrolytically remove nickelous ion as nickel metal from the ferric chloride etchant.

Figure 5:
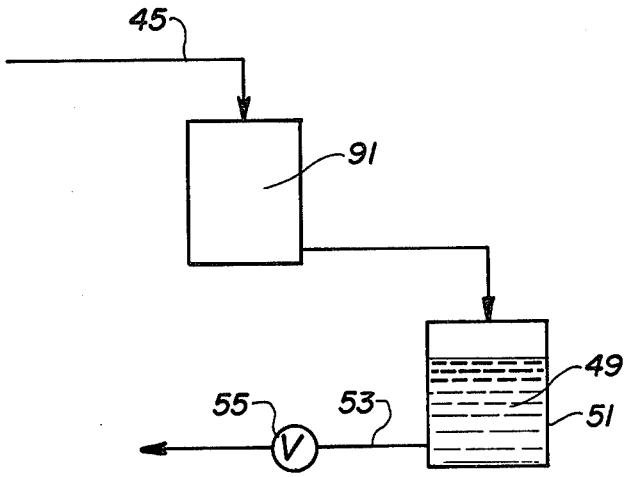
FIG. 5 is a schematic representation of a recovery apparatus for regenerating ferric chloride etchant.

FIG. 5 shows a recovery apparatus 91 that can be added to the apparatus shown in FIG. 1 for collecting the overflow etchant from the overflow pipe 45 which contains nickelous ions. Part or all of the nickelous ions are removed from the etchant, and then the recovered etchant is added to the etchant in the reservoir 51. The recovery apparatus may be similar to the apparatus shown in U.S. Pat. No. 4,396,475 cited above, or the apparatus shown in U.S. Pat. No. 3,788,915 issued Jan. 29, 1974 to M. Gulla which discloses a method for regenerating spent etchant solutions electrolytically.

What is claimed is:

1. A method for etching apertures into a strip of iron-nickel alloy, said strip having etch-resistant stencils on opposite major surfaces thereof, said method comprising contacting said stencilled major surfaces of said strip with ferric-chloride etchant (a) containing not more than 5 molar percent nickel ion with respect to the total molar content of nickel and iron ions in said etchant, (b) having a specific gravity greater than about 1.495 (48° Baumé) and (c) having a temperature greater than 70° C.

2. The method defined in claim 1 wherein said etchant has a specific gravity of about 1.510 (49.0° Baumé) and a temperature of about 75° C.

3. The method defined in claim 1 wherein said etchant has a specific gravity in the range of about 1.495 to 1.555 (48.0° to 52.0° Baumé) and a temperature in the range of about 70° to 85° C.

4. The method defined in claim 1 wherein said etchant is sprayed on said stencilled major surfaces.

5. The method defined in claim 1 wherein (a) said etchant is pumped from a sump and sprayed upon said surfaces, (b) said sprayed etchant drains back to said sump and (c) a controlled amount of the etchant in said sump is continuously removed from said sump and replaced with fresh etchant that is free from nickel cations.

6. The method defined in claim 1 wherein said alloy contains at least 10 weight percent nickel.

7. A method for etching a plurality of apertured masks into a strip of nickel-iron alloy including the steps of (i) producing a plurality of etch-resistant stencils successively on opposite major surfaces of said strip, (ii) passing said stencilled strip successively through an etching station, and while the strip portion is in said station (iii) spraying said major surfaces, with ferric chloride etchant, whereby the etchant dissolves portions of said strip not protected by said stencils thereby introducing nickelous cations into said etchant and (iv) controlling said etchant (a) to contain 0 to 5 molar percent nickel ion with respect to the total molar content of nickel and iron ions in said etchant, (b) to have a specific gravity greater than about 1.495 l (48° Baumé) and (c) to have a temperature greater than 70° C.

8. The method defined in claim 7 wherein said etchant is pumped from a sump and sprayed upon said surfaces, said sprayed etchant is returned to said sump, and nickel ions are removed from the etchant in said sump as required to maintain the nickel cation content in the etchant being sprayed in said 0 to 5 molar percent range.

9. The method defined in claim 7 wherein said etchant is pumped from a sump and sprayed upon said surfaces, said sprayed etchant is returned to said sump, and nickel-containing etchant is removed and replaced with nickel-free etchant as required to maintain the nickel cation content of the etchant being sprayed in said 0 to 5 molar percent range.

10. The method defined in claim 7 wherein said etchant is pumped from a sump and sprayed upon said surfaces, said sprayed etchant drains back to said sump by gravity, and a predetermined amount of nickel-ion-containing etchant is continuously removed from said sump and replaced with ferric-chloride etchant that is essentially free from nickel cations.

11. The method defined in claim 7 wherein minimum specific gravity y in degrees Baumé of said etchant being sprayed is $$y=47.824+0.337x=0.0131x^2+0.00017x^3$$

where x is the molar percent nickelous ion contained in said etchant.

12. The method defined in claim 11 wherein the specific gravity of said etchant being sprayed is about 48° to 51° Baumé.

13. The method defined in claim 12 wherein the temperature of said etchant being sprayed is about 70° to 85° C.

14. The method defined in claim 13 wherein said alloy contains about 36 weight percent nickel.

15. A method for continuously etching a plurality of apertured masks into successive portions of a strip of iron-nickel alloy, said strip having etch-resistant stencils on opposite major surfaces thereof, said method comprising (i) providing a reservoir of ferric-chloride etchant, (ii) spraying from said reservoir said etchant (a) containing no more than 5 molar percent nickel ion with respect to the total molar content of nickel and iron ions in said etchant, (b) having a specific gravity greater than about 1.495 (48° Baumé) and (c) having a temperature greater than 70° C., (iii) recovering sprayed etchant, (iv) returning said recovered etchant to said reservoir, and (v) continuously removing nickelous cations from said etchant in such manner as to maintain the concentration of nickel ions in said sprayed etchant at no more than 5 molar percent.

16. The method defined in claim 15 wherein nickelous ions are continuously removed by removing a relatively small quantity of nickel-ion-containing etchant from said reservoir and adding to the etchant in said system a similar quantity of etchant that has a lower concentration less than 1 molar percent nickel ions.

17. The method defined in claim 15 wherein nickelous ions are continuously removed electrolytically.

18. The method defined in claim 15 wherein nickelous ions are continuously removed by ion exchange through a porous membrane.

* * * * *

UNITED STATES PATENT AND TRADEMARK OFFICE

CERTIFICATE OF CORRECTION

PATENT NO. : 4,482,426

DATED : November 13, 1984

INVENTOR(S) : Richard Bruce Maynard et al.

It is certified that error appears in the above-identified patent and that said Letters Patent is hereby corrected as shown below:

| | |
|---|---|
| Column 1, line 18 | change "mre" to --more-- |
| Column 2, line 1 | change "since" to --Since-- |
| Column 2, line 12 | change "$\leq$" to --$\geq$-- |
| Column 6, line 51 | after "1.495" delete "I" |

Signed and Sealed this

*Twenty-sixth* Day of *March 1985*

[SEAL]

*Attest:*

DONALD J. QUIGG

*Attesting Officer* *Acting Commissioner of Patents and Trademarks*